US011424560B2

(12) United States Patent
Watkins

(10) Patent No.: US 11,424,560 B2
(45) **Date of Patent: *Aug. 23, 2022**

(54) COAXIAL CONNECTOR HAVING A GROUNDING MEMBER

(71) Applicant: PPC Broadband, Inc., East Syracuse, NY (US)

(72) Inventor: Harold John Watkins, Chittenango, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/399,643

(22) Filed: Apr. 30, 2019

(65) Prior Publication Data

US 2019/0356065 A1 Nov. 21, 2019

Related U.S. Application Data

(63) Continuation-in-part of application No. 16/012,660, filed on Jun. 19, 2018, now Pat. No. 10,276,951, which is a continuation of application No. 15/361,366, filed on Nov. 25, 2016, now Pat. No. 10,003,140.

(60) Provisional application No. 62/260,175, filed on Nov. 25, 2015.

(51) Int. Cl.

| | |
|---|---|
| ***H01R 9/05*** | (2006.01) |
| ***H01R 24/38*** | (2011.01) |
| ***H01R 103/00*** | (2006.01) |

(52) U.S. Cl.

CPC ..... *H01R 9/0521* (2013.01); *H01R 24/38* (2013.01); *H01R 2103/00* (2013.01)

(58) Field of Classification Search

CPC .... H01R 9/0521; H01R 24/38; H01R 9/0524; H01R 9/0503; H01R 9/0518; H01R 9/05; H01R 4/5033; H01R 4/029

USPC ..... 439/584

See application file for complete search history.

(56) References Cited

U.S. PATENT DOCUMENTS

| | | | | |
|---|---|---|---|---|
| 2,901,528 A * | 8/1959 | Lazar | H01R 9/0512 174/75 C |
| 4,453,796 A * | 6/1984 | Monroe | H01R 9/0518 439/581 |
| 5,938,465 A | 8/1999 | Fox, Sr. | |
| 7,479,035 B2 * | 1/2009 | Bence | H01R 9/05 439/583 |

(Continued)

OTHER PUBLICATIONS

Mar. 24, 2017 International Search Report issued in Intematinal Application No. PCT/US16/63793.

*Primary Examiner* — Jean F Duverne

(74) *Attorney, Agent, or Firm* — MH2 Technology Law Group LLP

(57) ABSTRACT

A cable connector includes an outer conductor engager portion configured to receive an end of a coaxial cable, a coupler portion connected with the outer conductor engager portion, and a radially compressible grounding portion at a forward end of the outer conductor engager portion. The radially compressible grounding portion is configured to be radially compressed when the coupler portion is coupled with an interface port and to establish an electrical grounding path between the outer conductor engager portion and the interface port, even when the coupler portion is only loosely coupled with the interface port.

17 Claims, 7 Drawing Sheets

(56) References Cited

U.S. PATENT DOCUMENTS 8,075,337 B2 12/2011 Malloy et al.
8,197,283 B2 6/2012 Radzik et al.
8,287,320 B2 10/2012 Purdy et al.
8,876,550 B1 11/2014 Krenceski et al.
9,004,931 B2 4/2015 Montena
9,039,446 B2 5/2015 Youtsey
9,130,281 B2 9/2015 Phillips, Jr. et al.
2003/0207610 A1* 11/2003 Lindemann ..... H01R 4/5033 439/427
2007/0281542 A1 12/2007 Palinkas et al.
2008/0139045 A1* 6/2008 Ho ..... H01R 9/0521 439/578
2008/0254668 A1 10/2008 Rosenberger
2009/0215306 A1* 8/2009 Hanks ..... H01R 4/5033 439/427
2010/0130060 A1* 5/2010 Islam ..... H01R 9/0521 439/584
2010/0261382 A1 10/2010 Montena et al.
2011/0250789 A1 10/2011 Burris et al.
2012/0129391 A1* 5/2012 Van Swearingen .... H01R 4/029 439/578
2013/0034983 A1* 2/2013 Purdy ..... H01R 9/0524 439/277
2013/0115813 A1* 5/2013 Ehret ..... H01R 9/05 439/583
2013/0143439 A1* 6/2013 Nugent ..... H01R 9/0518 439/585
2014/0162493 A1 6/2014 Lu
2014/0235099 A1 8/2014 Burris et al.
2014/0315448 A1* 10/2014 Phillips, Jr. ..... H01R 9/0524 439/805
2015/0118898 A1* 4/2015 Paynter ..... H01R 9/0503 333/24 C

* cited by examiner

COAXIAL CONNECTOR HAVING A GROUNDING MEMBER

CROSS-REFERENCE TO RELATED APPLICATIONS

This application is a continuation of U.S. application Ser. No. 16/012,660, filed Jun. 19, 2018, which is a continuation of U.S. application Ser. No. 15/361,366, filed Nov. 25, 2016, now U.S. Pat. No. 10,003,140, which is a non-provisional application that claims the benefits of priority of U.S. Provisional Application No. 62/260,175, filed on Nov. 25, 2015, the disclosure of which is incorporated herein by reference in its entirety.

BACKGROUND

A coaxial cable is prepared for connection to another cable, or to another RF device, by a coaxial cable connector. Preparation typically requires the use of several specialized tools including a stripping tool and a compression tool. The stripping tool removes a portion of the compliant outer jacket to expose a signal-carrying inner conductor and an outer grounding, or braided, conductor of the cable. The compression tool, on the other hand, inserts a grounding/retention post into the prepared end of the cable to effect an electrical and mechanical connection between the cable and an outer body or housing of the cable connector.

The step of compressing/inserting the grounding/retention post into the prepared end of the coaxial cable also requires a holding fixture to align the prepared end of the cable while a driver compresses a barbed annular sleeve of the grounding/retention post into/beneath the outer jacket of the cable. As such, the outer jacket may be compressed between the barbed annular sleeve and a fixed-diameter outer housing of the cable connector. Compression of the outer jacket causes the barbed annular sleeve to engage the braided conductor of the cable, thereby retaining the grounding/retention post of the connector to the coaxial cable.

SUMMARY

According to various aspects of the disclosure, a cable connector includes an outer conductor engager, a body, a coupler, a compression sleeve, a radially compressible grounding member, and an end cap. The outer conductor engager is configured to receive an end of a coaxial cable and has an outer circumferential surface defining an annular groove. The body includes an annular ring portion coaxially aligned with the outer conductor engager along an axis, and the annular ring is configured to circumscribe the coaxial cable. The coupler is rotatably mounted relative to the outer conductor engager and the body, and the compression sleeve is disposed at an opposite axial side of the body relative to the coupler. The radially compressible grounding member is configured to establish an electrical grounding path between the outer conductor engager and the coupler, and the end cap has a radial projection slidably retained in the groove. As the coupler is threadably coupled to an interface port, the end cap slides axially in the groove and urges the grounding member into a forward end of the outer conductor engager.

In some aspects, the forward end of the outer conductor engager has a tapered inner surface configured to radially compress the grounding member as the grounding member is urged into the forward end of the outer conductor engager.

According to some aspects, a cable connector may include an outer conductor engager configured to receive an end of a coaxial cable and a body including an annular ring portion coaxially aligned with the outer conductor engager along an axis. The annular ring may be configured to circumscribe the coaxial cable. A coupler may be rotatably mounted relative to the outer conductor engager and the body, and a radially compressible grounding member may be disposed in a forward end of the outer conductor engager. The radially compressible grounding member may be configured to establish an electrical grounding path between the outer conductor engager and an interface port, even when the coupler is only loosely tightened to the interface port.

In some aspects, the outer conductor engager has an outer circumferential surface defining an annular groove, the cable connector includes an end cap having a radial projection slidably retained in the groove, and as the coupler is threadably coupled to the interface port, the end cap slides axially in the groove and urges the grounding member into the forward end of the outer conductor engager. In various aspects, the forward end of the outer conductor engager has a tapered inner surface configured to radially compress the grounding member as the grounding member is urged into the forward end of the outer conductor engager.

In accordance with various aspects of the disclosure, a cable connector may include an outer conductor engager configured to receive an end of a coaxial cable, a coupler rotatably mounted relative to the outer conductor engager, and a radially compressible grounding member disposed in a forward end of the outer conductor engager. The radially compressible grounding member may be configured to establish an electrical grounding path between the outer conductor engager and an interface port, even when the coupler is only loosely tightened on the interface port.

According to some aspects, the connector may include a body having an annular ring portion coaxially aligned with the outer conductor engager along an axis, the annular ring is configured to circumscribe the coaxial cable, and the coupler is configured to rotate relative to the body. In various aspects, the outer conductor engager has an outer circumferential surface defining an annular groove, the cable connector includes an end cap having a radial projection slidably retained in the groove, and as the coupler is threadably coupled to the interface port, the end cap slides axially in the groove and urges the grounding member into the forward end of the outer conductor engager.

In some aspects, the end cap is L-shaped and has a radially-inward extending portion disposed forward of the end cap and an axial extending portion surrounding the radially compressible grounding member and a portion of the outer conductor engager. The axial extending portion of the end cap may have a radially-inward extending flange that extends into the annular groove. The annular groove may be configured to limit forward and rearward movement of the end cap in the axial direction.

According to various aspects, in a rest position, the radially compressible grounding member urges the end cap to a forwardmost position relative to the outer conductor engage. When the coupler is loosely tightened on the interface port, the end cap engages the interface port. When the coupler is fully tightened on the interface port, the end cap is urged in a rearward direction, which in turn urges the radially compressible grounding member in the rearward direction. In some aspects, the forward end of the outer conductor engager has a tapered inner surface configured to radially compress the grounding member as the grounding member is urged rearwardly.

In some aspects, the cable connector may include a compression sleeve disposed at an opposite axial side of the body relative to the coupler. The compression sleeve may have a tapered inner surface configured to urge the body radially inward as the compression sleeve is moved in a forward direction relative to the body.

According to some aspects, the radially compressible grounding member may be a C-shaped washer or ring.

BRIEF DESCRIPTION OF THE DRAWINGS

Features and advantages of the present disclosure are described in, and will be apparent from, the following Brief Description of the Drawings and Detailed Description.

DETAILED DESCRIPTION

Figure 1:
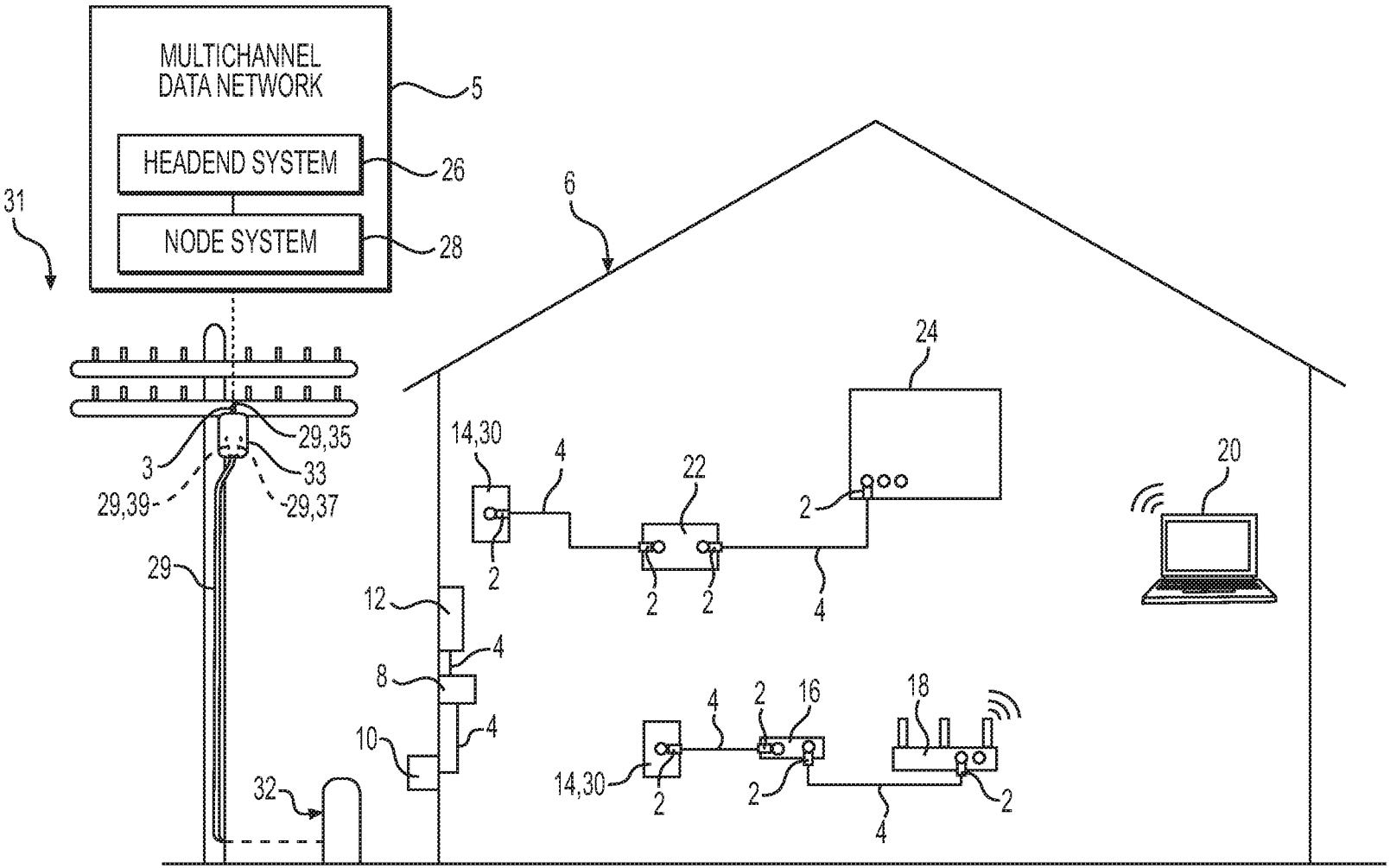
FIG. 1 is a schematic view of an exemplary network environment in accordance with various aspects of the disclosure.

Referring to FIG. 1, cable connectors 2 and 3 enable the exchange of data signals between a broadband network or multichannel data network 5, and various devices within a home, building, venue or other environment 6. For example, the environment's devices can include: (a) a point of entry ("PoE") filter 8 operatively coupled to an outdoor cable junction device 10; (b) one or more signal splitters within a service panel 12 which distributes the data service to interface ports 14 of various rooms or parts of the environment 6; (c) a modem 16 which modulates radio frequency ("RF") signals to generate digital signals to operate a wireless router 18; (d) an Internet accessible device, such as a mobile phone or computer 20, wirelessly coupled to the wireless router 18; and (e) a set-top unit 22 coupled to a television ("TV") 24. In one embodiment, the set-top unit 22, typically supplied by the data provider (e.g., the cable TV company), includes a TV tuner and a digital adapter for High Definition TV.

In some embodiments, the multichannel data network 5 includes a telecommunications, cable/satellite TV ("CATV") network operable to process and distribute different RF signals or channels of signals for a variety of services, including, but not limited to, TV, Internet and voice communication by phone. For TV service, each unique radio frequency or channel is associated with a different TV channel. The set-top unit 22 converts the radio frequencies to a digital format for delivery to the TV. Through the data network 5, the service provider can distribute a variety of types of data, including, but not limited to, TV programs including on-demand videos, Internet service including wireless or WiFi Internet service, voice data distributed through digital phone service or Voice Over Internet Protocol ("VoIP") phone service, Internet Protocol TV ("IPTV") data streams, multimedia content, audio data, music, radio and other types of data.

In some embodiments, the multichannel data network 5 is operatively coupled to a multimedia home entertainment network serving the environment 6. In one example, such multimedia home entertainment network is the Multimedia over Coax Alliance ("MoCA") network. The MoCA network increases the freedom of access to the data network 5 at various rooms and locations within the environment 6. The MoCA network, in one embodiment, operates on cables 4 within the environment 6 at frequencies in the range of 1125 MHz to 1675 MHz. MoCA compatible devices can form a private network inside the environment 6.

As described above, the data service provider uses coaxial cables 29 and 4 to distribute the data to the environment 6. The environment 6 has an array of coaxial cables 4 at different locations. The connectors 2 are attachable to the coaxial cables 4. The cables 4, through use of the connectors 2, are connectable to various communication interfaces within the environment 6, such as the female interface ports 14 illustrated in FIGS. 1-2. In the examples shown, female interface ports 14 are incorporated into: (a) a signal splitter within an outdoor cable service or distribution box 32 which distributes data service to multiple homes or environments 6 close to each other; (b) a signal splitter within the outdoor cable junction box or cable junction device 10 which distributes the data service into the environment 6; (c) the set-top unit 22; (d) the TV 24; (e) wall-mounted jacks, such as a wall plate; and (f) the router 18.

Figure 2:
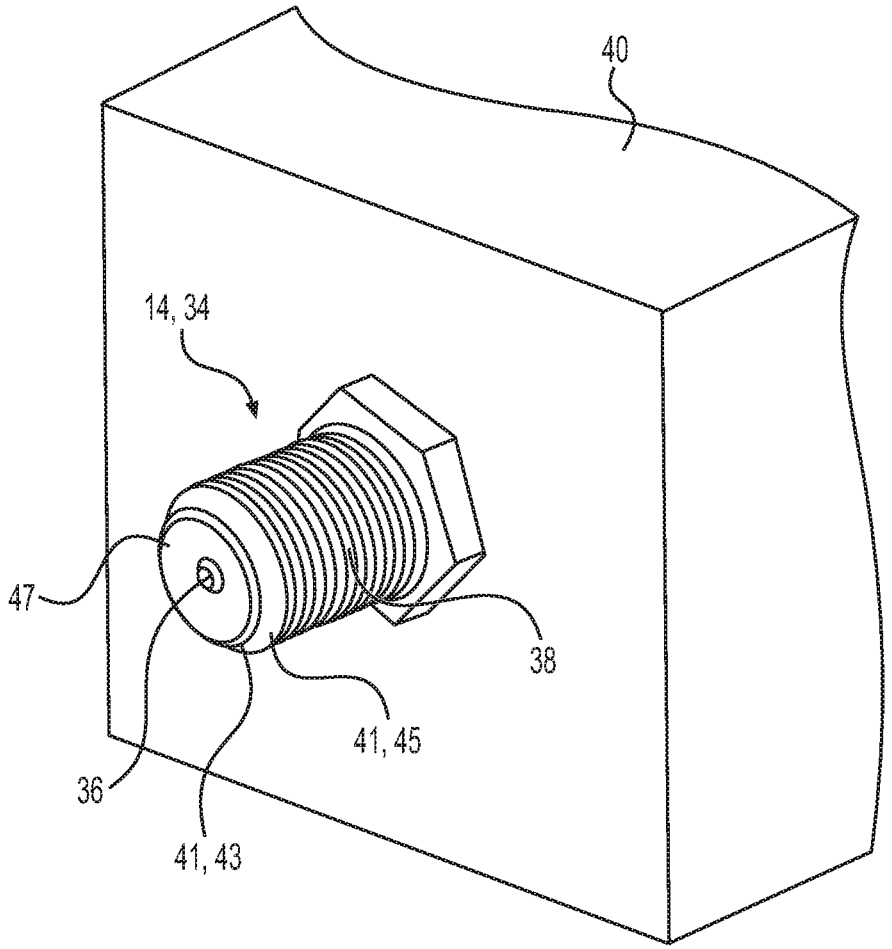
FIG. 2 is a perspective view of an exemplary interface port in accordance with various aspects of the disclosure.

In one embodiment, each of the female interface ports 14 includes a stud or jack, such as the cylindrical stud 34 illustrated in FIG. 2. The stud 34 has: (a) an inner, cylindrical wall 36 defining a central hole configured to receive an electrical contact, wire, pin, conductor (not shown) positioned within the central hole; (b) a conductive, threaded outer surface 38; (c) a conical conductive region 41 having conductive contact sections 43 and 45; and (d) a dielectric or insulation material 47.

In some embodiments, stud 34 is shaped and sized to be compatible with the F-type coaxial connection standard. It should be understood that, depending upon the embodiment, stud 34 could have a smooth outer surface. The stud 34 can be operatively coupled to, or incorporated into, a device 40 which can include, for example, a cable splitter of a distribution box 32, outdoor cable junction box 10 or service panel 12; a set-top unit 22; a TV 24; a wall plate; a modem 16; a router 18; or the junction device 33.

During installation, the installer couples a cable 4 to an interface port 14 by screwing or pushing the connector 2 onto the female interface port 34. Once installed, the connector 2 receives the female interface port 34. The connector 2 establishes an electrical connection between the cable 4 and the electrical contact of the female interface port 34.

Figure 4:
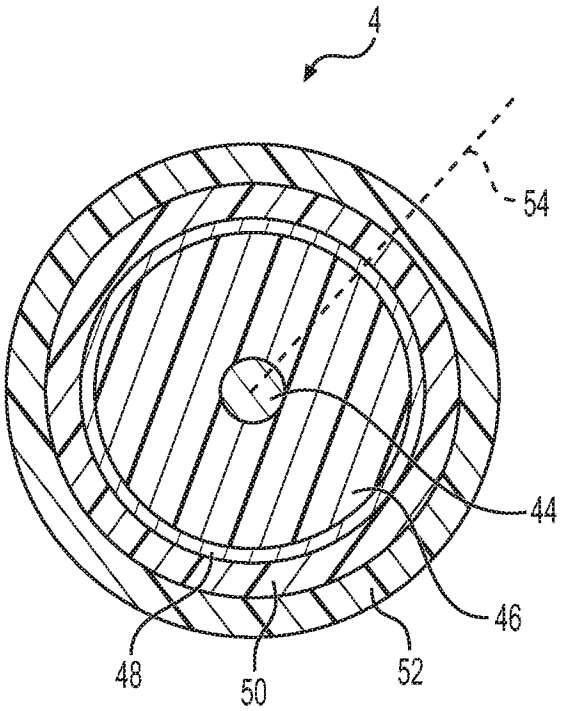
FIG. 4 is a cross-sectional view of the exemplary coaxial cable of FIG. 3.
Figure 3:
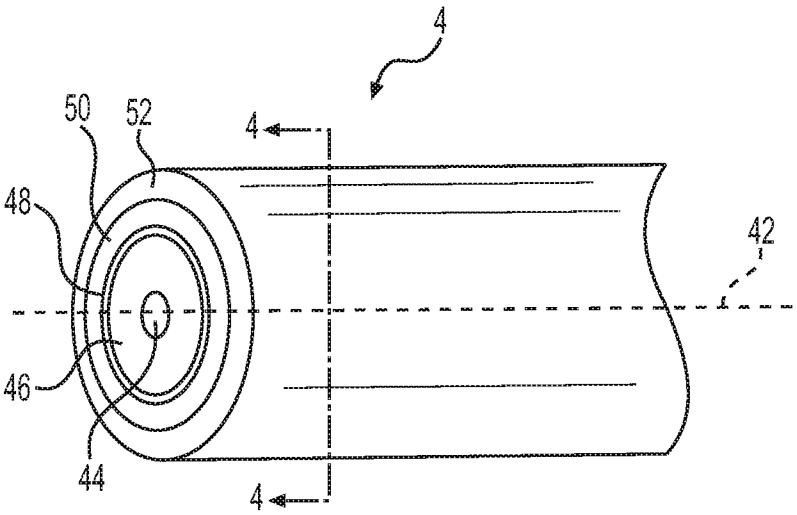
FIG. 3 is a perspective view of an exemplary coaxial cable in accordance with various aspects of the disclosure.
Figure 5:
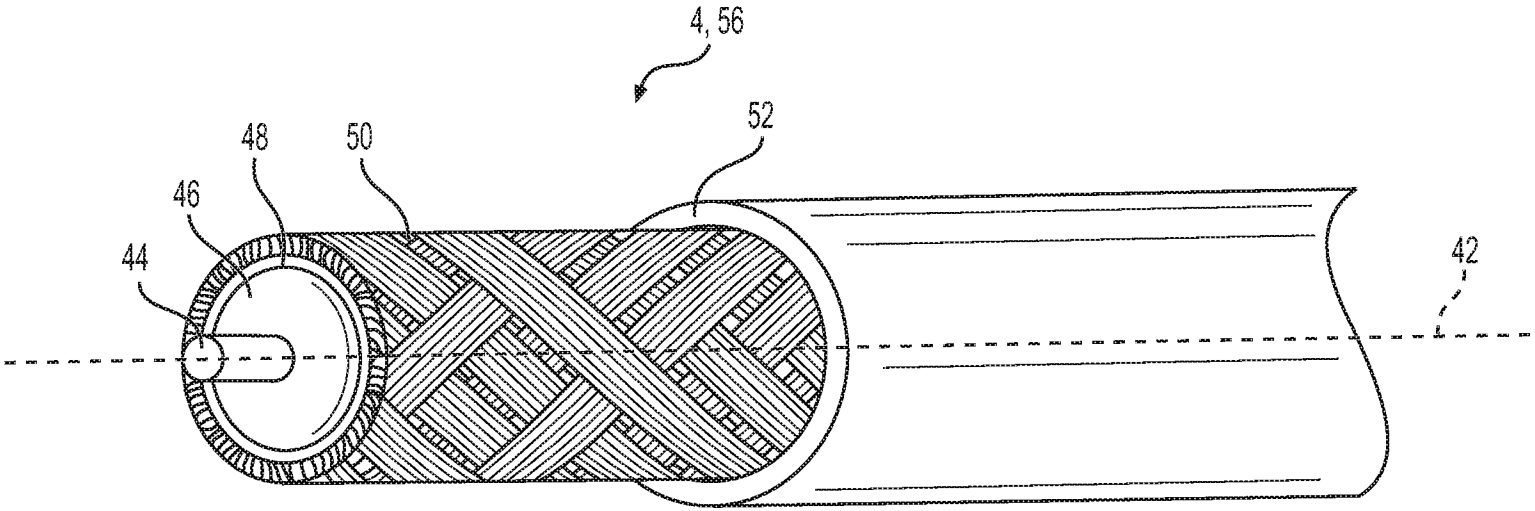
FIG. 5 is a perspective view of an exemplary prepared end of the exemplary coaxial cable of FIG. 3.

Referring to FIGS. 3-5, the coaxial cable 4 extends along a cable axis or a longitudinal axis 42. In one embodiment, the cable 4 includes: (a) an elongated center conductor or inner conductor 44; (b) an elongated insulator 46 coaxially surrounding the inner conductor 44; (c) an elongated, conductive foil layer 48 coaxially surrounding the insulator 46; (d) an elongated outer conductor 50 coaxially surrounding the foil layer 48; and (e) an elongated sheath, sleeve or jacket 52 coaxially surrounding the outer conductor 50.

The inner conductor 44 is operable to carry data signals to and from the data network 5. Depending upon the embodiment, the inner conductor 44 can be a strand, a solid wire or a hollow, tubular wire. The inner conductor 44 is, in one embodiment, constructed of a conductive material suitable for data transmission, such as a metal or alloy including copper, including, but not limited, to copper-clad aluminum ("CCA"), copper-clad steel ("CCS") or silver-coated copper-clad steel ("SCCCS").

The insulator 46, in some embodiments, is a dielectric having a tubular shape. In one embodiment, the insulator 46 is radially compressible along a radius or radial line 54, and the insulator 46 is axially flexible along the longitudinal axis 42. Depending upon the embodiment, the insulator 46 can be a suitable polymer, such as polyethylene ("PE") or a fluoropolymer, in solid or foam form.

In the embodiment illustrated in FIG. 3, the outer conductor 50 includes a conductive RF shield or electromagnetic radiation shield. In such embodiment, the outer conductor 50 includes a conductive screen, mesh or braid or otherwise has a perforated configuration defining a matrix, grid or array of openings. In one such embodiment, the braided outer conductor 50 has an aluminum material or a suitable combination of aluminum and polyester. Depending upon the embodiment, cable 4 can include multiple, overlapping layers of braided outer conductors 50, such as a dual-shield configuration, tri-shield configuration or quad-shield configuration.

In one embodiment, the connector 2 electrically grounds the outer conductor 50 of the coaxial cable 4. The conductive foil layer 48, in one embodiment, is an additional, tubular conductor which provides additional shielding of the magnetic fields. In one embodiment, the jacket 52 has a protective characteristic, guarding the cable's internal components from damage. The jacket 52 also has an electrical insulation characteristic.

Referring to FIG. 5, in one embodiment an installer or preparer prepares a terminal end 56 of the cable 4 so that it can be mechanically connected to the connector 2. To do so, the preparer removes or strips away differently sized portions of the jacket 52, outer conductor 50, foil 48 and insulator 46 so as to expose the side walls of the jacket 52, outer conductor 50, foil layer 48 and insulator 46 in a stepped or staggered fashion. In the example shown in FIG. 5, the prepared end 56 has a two step-shaped configuration. In some embodiments, the prepared end has a three step-shaped configuration (not shown), where the insulator 46 extends beyond an end of the foil 48 and outer conductor 50. At this point, the cable 4 is ready to be connected to the connector 2.

Depending upon the embodiment, the components of the cable 4 can be constructed of various materials which have some degree of elasticity or flexibility. The elasticity enables the cable 4 to flex or bend in accordance with broadband communications standards, installation methods or installation equipment. Also, the radial thicknesses of the cable 4, the inner conductor 44, the insulator 46, the conductive foil layer 48, the outer conductor 50 and the jacket 52 can vary based upon parameters corresponding to broadband communication standards or installation equipment.

Figure 6:
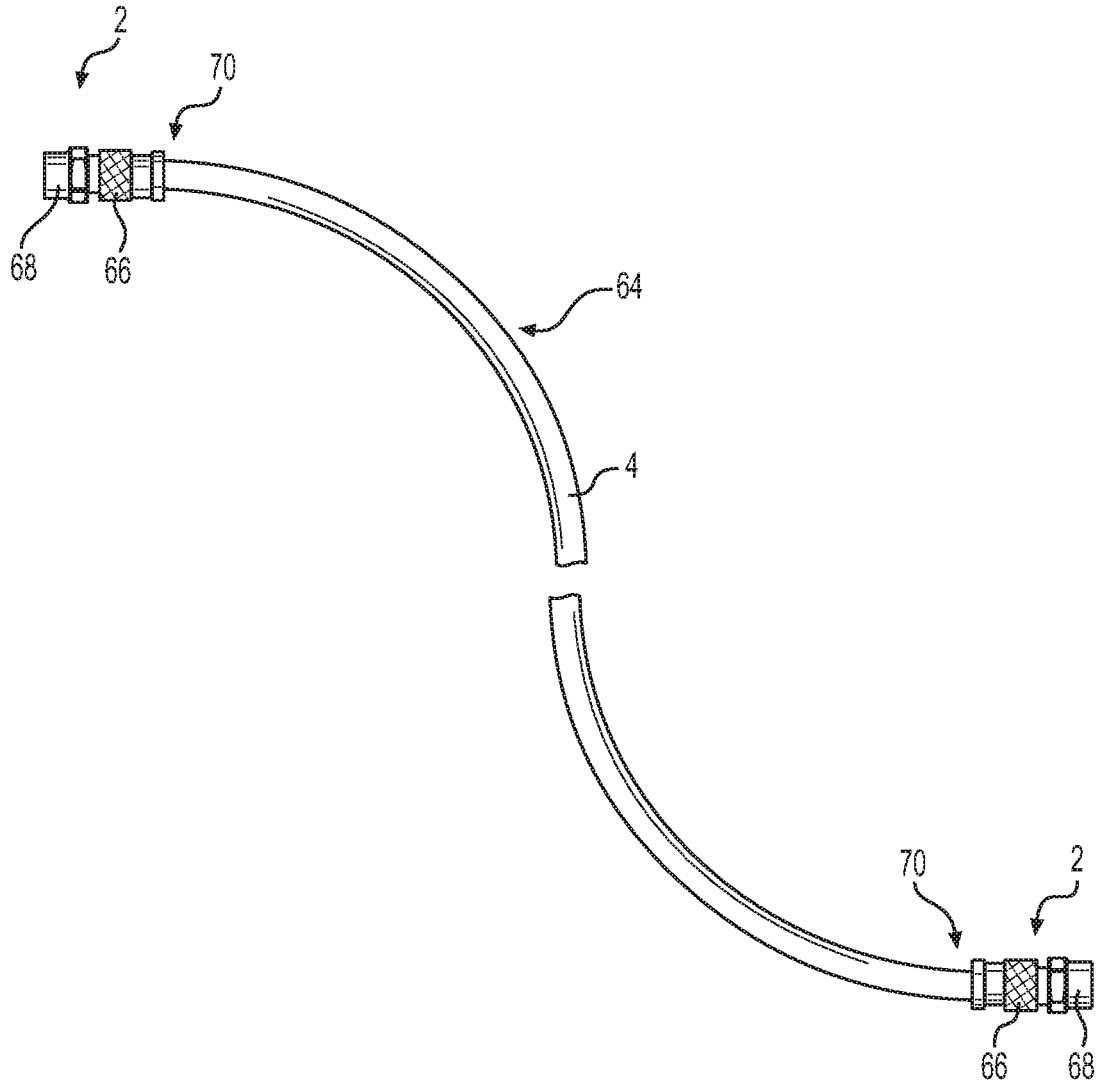
FIG. 6 is a top view of one embodiment of a coaxial cable jumper or cable assembly which is configured to be operatively coupled to the multichannel data network.

In one embodiment illustrated in FIG. 6, a cable jumper or cable assembly 64 includes a combination of the connector 2 and the cable 4 attached to the connector 2. In this embodiment, the connector 2 includes a connector body or connector housing 66 and a fastener or coupler 68, such as a threaded nut, which is rotatably coupled to the connector housing 66. The cable assembly 64 has, in one embodiment, connectors 2 on both of its ends 70. In some embodiments, the cable assembly 64 may have a connector 2 on one end and either no connector or a different connector at the other end. Preassembled cable jumpers or cable assemblies 64 can facilitate the installation of cables 4 for various purposes.

The cable connector of the present disclosure provides a reliable electrical ground, a secure axial connection and a watertight seal across leakage-prone interfaces of the coaxial cable connector.

The cable connector comprises an outer conductor engager or post, a housing or body, and a coupler or threaded nut to engage an interface port. The outer conductor engager includes an aperture for receiving the outer braided conductor of a prepared coaxial cable, i.e., an end which has been stripped of its outer jacket similar to that shown in FIG. 5, and a plurality of resilient fingers projecting axially away from the interface port. The body receives and engages the resilient fingers of the outer conductor engage to align the body with the outer conductor engager in a pre-installed state.

Figure 7:
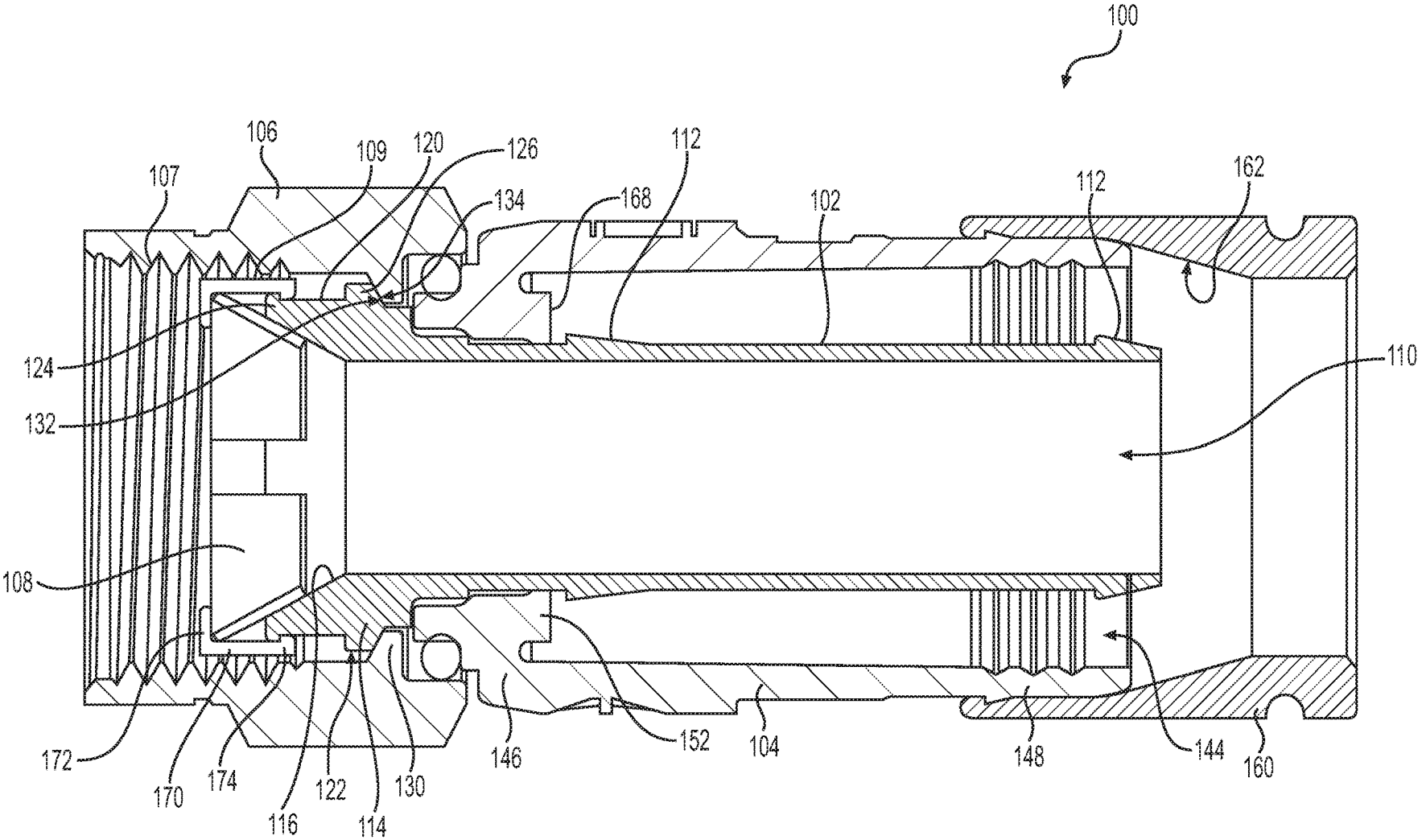
FIG. 7 is a cross-sectional view of an exemplary connector disposed in accordance with various aspects of the disclosure.
Figure 9:
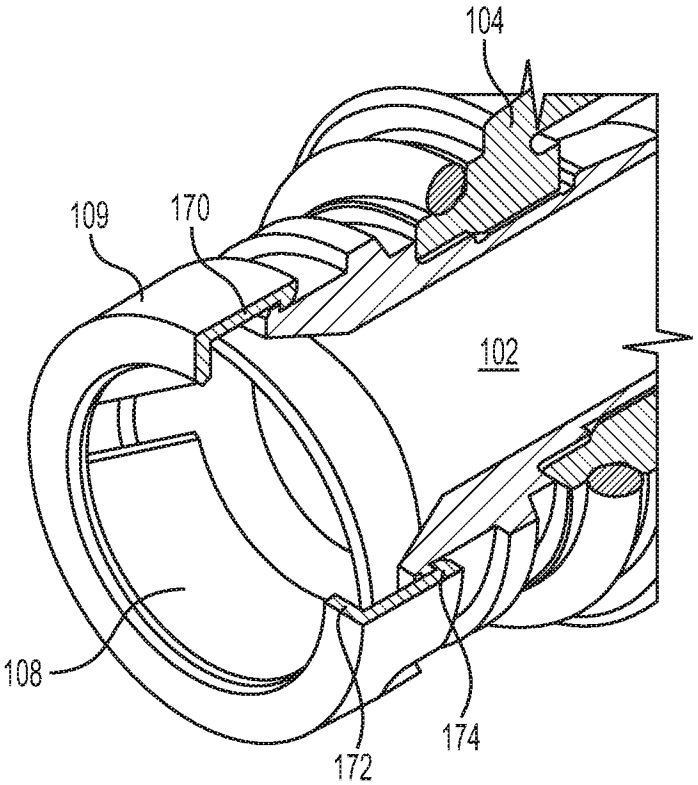
FIG. 9 is an isometric view of a forward end of the connector with the coupler removed.

According to the disclosure, the aforementioned connectors 2 may be configured as coaxial cable connector 100, as illustrated in FIG. 7. For the purposes of establishing a directional frame of reference, the forward and rearward directions relative to the connector 100 are given by arrows F and R, respectively. When the connector 100 is installed on an interface port 14, a forward end, portion, or direction is proximal to, or toward, the interface port 14, and a rearward end, portion, or direction is distal, or away, from the interface port 14.

For purposes of this disclosure, with reference to the connector 100, a pre-installed or uninstalled state or configuration refers to the connector 100 before it is coupled with the coaxial cable 4 and the interface port 14. A partially-installed/assembled state refers to the connector 100 when it is coupled with the coaxial cable 4, but not with the interface port 14. An installed or fully-installed state refers to the connector 100 when it is coupled with the coaxial cable 4 and the interface port 14.

Referring now to FIG. 7, the coaxial cable connector 100 includes an outer conductor engager or post 102, a connector body or housing 104, and a threaded coupler 106. The outer conductor engager 102 includes a forward flange 114 and an aperture 110 for accepting a portion of the coaxial cable 4. The forward flange 114 includes an annular groove 120 extending about its outer peripheral surface 122. The annular groove 120 has a predetermined length in the axial direction of the coaxial connector 100 delimited by a forward radially-outward projection 124 and a rearward radially-outward projection 126 of the forward flange 114.

In the described embodiment, the outer conductor engager 102 is configured to be inserted between outer conductor 50 and insulator 46. Outward-facing barbs 112 of the outer conductor engager 102 are structured and arranged to establish contact with outer conductor 50 providing for mechanical and electrical continuity between outer conductor 50 and outer conductor engager 102, and, thereby, coaxial cable connector 100. In this way, electrical continuity, and accordingly a ground path and RFI shield, may be established and maintained from outer conductor 50 of coaxial cable through outer conductor engager 102, connector body 104, grounding member 108, and coupler 106 to interface port 14.

The connector body 104 defines an aperture 144 for receiving a portion of the coaxial cable 4. The body 104 includes a forward annular ring portion 146 and a rearward annular ring portion 148. The rearward annular portion is configured to engage a compression ring 160.

The threaded coupler 106 includes a threaded portion 107 at its forward end for threadably engaging the threaded outer surface 38 of the interface port 14. A rearward end of the threaded coupler 106 is bearing-mounted to the forward flange 114 of the outer conductor engager 102 such that the coupler 106 is rotatable relative to the outer conductor engager 102 and the connector body 104. For example, a forward-facing surface 132 of an inwardly-extending flange 130 of the coupler 106 bears against a rearward-facing surface 134 of the rearward radially-outward projection 126 of the forward flange 114 of the outer conductor engager 102.

Figure 8:
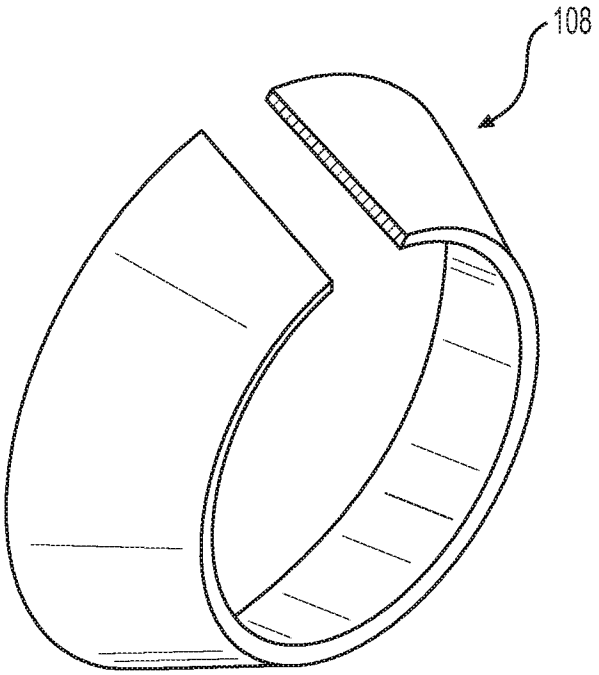
FIG. 8 is an isometric view of the grounding member of the connector of FIG. 7.

The connector also includes a conductive grounding member 108 and a conductive end cap 109. The grounding member 108 may be configured as a beveled washer or ring, as shown in FIG. 8. The grounding member 108 may be C-shaped, thereby providing the grounding member 108 with radial resiliency/compressibility. The grounding member 108 is configured to be received at a forward end of the forward flange 114 of the outer conductor engager 102. The forward flange 114 has a tapered inner surface 116 at its forward end, which narrows in the rearward direction.

The end cap 109 may have a substantially L-shaped configuration, with a first portion 170 extending in the axial direction of the connector 100 and a second portion 172 extending radially from a forward end of the first portion 170. However, the rearward end of the first portion 170 also includes a rear radial projection 174 configured to cooperate with the forward radially-outward projection 124 and the rearward radially-outward projection 126 that delimit the annular groove 120 of the forward flange 114 to limit the axial movement of the end cap 109 relative to the outer conductor engager 102 and to prevent the end cap 109 from becoming detached from the outer conductor engager 102 in the pre-installed and partially-installed states.

In the pre-installed and partially-installed states, the grounding member 108 is partially received by the tapered inner surface 116 of the forward flange 114, and the rear radial projection 174 of the end cap 109 engages the forward radially-outward projection 124 of the forward flange 114.

Having described the components of the connector 100 in detail, the use of connector 100 in terminating a coaxial cable 4 is now described. Cable 4 is prepared in conventional fashion for termination, as described above.

As shown in FIG. 7, when the connector is in the pre-installed and partially-installed states, the grounding member 108 is partially received by the tapered inner surface 116 of the forward flange 114, and the rear radial projection 174 of the end cap 109 engages the forward radially-outward projection 124 of the forward flange 114.

In the partially-installed state, the coaxial cable 4 is inserted into the connector 100 (not shown). For example, the inner conductor 44, the insulator 46, the outer conductor 50, and the outer jacket 52 are inserted through the aperture 144 of the body 104. Particularly, the coaxial cable 4 is inserted into the connector 100 until a forward stop surface along the outer jacket 52 of the coaxial cable 4 abuts a rearward-facing stop surface 168 of the first inward-facing lip 152 of the body 104. The inner conductor 44 and the insulator 46 extend through the aperture 110, and the inner conductor 44 extends beyond the forward flange 114 of the outer conductor engager 102.

The cable 4 may be inserted into connector 100 with the compression sleeve 160 coupled to the rear portion 148 of the connector body 104. Once the cable 4 is properly inserted, the compression sleeve 160 may be moved forward from a first position to a second position, where the compression sleeve 160 is moved axially forward so that a tapered wall 162 of the compression sleeve rides over the rear portion 148 of the connector body 104. A suitable tool may be used to effect movement of compression sleeve 160 from its first position to its second position securing the cable 4 to the connector body 104.

As the compression sleeve 160 is urged to move forwardly, the connector body 104 compresses the outer jacket 52 between the body 104 and the outer conductor engager 102 and compresses the outer conductor engager 102 onto the insulator 46.

During installation of the connector 100 to an interface port 14, the coupler 106 threadably engages the interface port 14. As the coupler 106 is fastened to the interface port 14, for example, by rotating the coupler 106 relative to the interface port 14, the interface port 14 is drawn toward the end cap 109, the grounding member 108, and the forward flange 114 of the outer conductor engager 102. Eventually, the free end of the interface port 14 will engage the end cap 109 and continued rotation of the coupler 106 relative to the interface port 14 will urge the end cap 109 in the rearward direction, which in turn urges the grounding member 108 in the rearward direction. As the grounding member 108 is urged rearward, the grounding member 108 is compressed radially inward by the tapered inner surface 116 of the forward flange 114. When the coupler 106 is fully tightened to the interface port 14, the second portion 172 of the end cap 109 is adjacent a forward end of the forward flange 114, and the rear projection 174 of the end cap 109 is adjacent the rearward radially-outward projection 126 of the forward flange 114.

According to aspects of the connector disclosed herein, even when the coupler 106 is not fully tightened (i.e., loosely tightened), the free end of the interface port 14 will make direct contact with the end cap 109, at which time, the user will receive a tactile feedback that the coupler is nearly tightened. Therefore, the grounding member 108 and the end cap 109 establish and maintain an electrically-conductive and stable ground path between the coupler 106, the outer conductor engager 102, the outer conductor 50 of the coaxial cable 4, and the interface port 14, even when the coupler 106 is only loosely fastened (i.e., not fully tightened) to the interface port 14.

The embodiment of the present disclosure provides an apparatus and method for producing a reliable electrical ground, a secure mechanical connection, and a plurality of watertight seals to protect a coaxial cable connector. The apparatus and method eliminates the need to fold the outer conductor over the compliant outer jacket 52 of the coaxial cable 4.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A cable connector, comprising an outer conductor engager portion configured to receive an end of a coaxial cable;

a coupler portion connected with the outer conductor engager portion;

a radially compressible grounding portion configured to slide in an axial direction relative to the outer conductor engager portion;

wherein the radially compressible grounding portion is configured to be radially compressed when the coupler portion is coupled with an interface port and to establish an electrical grounding path between the outer conductor engager portion and the interface port;

the outer conductor engager portion has an outer circumferential surface defining an annular groove;

the cable connector includes an end cap having a radial projection slidingly retained in the groove; and the end cap is configured to slide axially in the groove and urge the radially compressible grounding portion into the forward end of the outer conductor engager portion as the coupler portion is threadedly coupled to the interface port.

2. The cable connector of claim 1, wherein the radially compressible grounding portion is configured to establish the electrical grounding path between the outer conductor engager portion and the interface port, even when the coupler portion is only loosely coupled with the interface port.

3. A cable connector, comprising an outer conductor engager portion configured to receive an end of a coaxial cable;

a coupler portion connected with the outer conductor engager portion;

a radially compressible grounding portion configured to slide in an axial direction relative to the outer conductor engager portion;

wherein the radially compressible grounding portion is configured to establish an electrical grounding path between the outer conductor engager portion and the interface port, even when the coupler portion is only loosely coupled with the interface port;

the outer conductor engager portion has an outer circumferential surface defining an annular groove;

the cable connector includes an end cap having a radial projection slidingly retained in the groove; and the end cap is configured to slide axially in the groove and urge the radially compressible grounding portion into the forward end of the outer conductor engager portion as the coupler portion is threadedly coupled to the interface port.

4. A cable connector, comprising an outer conductor engager portion having a rearward end configured to receive an end of a coaxial cable;

a coupler portion connected with the outer conductor engager portion; and a radially compressible grounding portion at a forward end of the outer conductor engager portion;

wherein the radially compressible grounding portion is configured to slide in an axial direction relative to the outer conductor engager portion;

wherein the radially compressible grounding portion is configured to be radially compressed when the coupler portion is coupled with an interface port and to establish an electrical grounding path between the outer conductor engager portion and the interface port, even when the coupler portion is only loosely coupled with the interface port;

the outer conductor engager portion has an outer circumferential surface facing radially outward and defining an annular groove;

the cable connector includes an end cap having a radial projection slidingly retained in the groove; and the end cap is configured to slide axially in the groove and urge the radially compressible grounding portion into the forward end of the outer conductor engager portion as the coupler portion is threadedly coupled to the interface port.

5. The cable connector of claim 4, further comprising:

a body portion coaxially aligned with the outer conductor engager portion along an axis, the body portion being configured to circumscribe the coaxial cable; and wherein the coupler portion is configured to rotate relative to the body portion.

6. The cable connector of claim 4, wherein the end cap is L-shaped and has a radially-inward extending portion disposed forward of the end cap and an axial extending portion surrounding the radially compressible grounding portion and a portion of the outer conductor engager portion.

7. The cable connector of claim 6, wherein the axial extending portion of the end cap has a radially-inward extending flange that extends into the annular groove.

8. The cable connector of claim 7, wherein the annular groove is configured to limit forward and rearward movement of the end cap in the axial direction.

9. The cable connector of claim 8, wherein, in a rest position, the radially compressible grounding portion is configured to urge the end cap to a forwardmost position relative to the outer conductor engager portion.

10. The cable connector of claim 9, wherein the end cap is configured to engage the interface port when the coupler portion is loosely tightened on the interface port.

11. The cable connector of claim 10, wherein, the end cap is configured to be urged in a rearward direction, which in turn urges the radially compressible grounding portion in the rearward direction, when the coupler portion is fully tightened on the interface port.

12. The cable connector of claim 11, wherein the forward end of the outer conductor engager portion has an inner surface that tapers inward in a direction away from the forward end and is configured to radially compress the grounding portion as the radially compressible grounding portion is urged rearwardly.

13. The cable connector of claim 4, wherein the radially compressible grounding portion and the end cap are configured to establish an electrically-conductive ground path between the coupler portion, the outer conductor engager portion, an outer conductor of the coaxial cable, and the interface port, even when the coupler portion is only loosely fastened to the interface port.

14. The cable connector of claim 5, further comprising a compression sleeve disposed at an opposite axial side of the body portion relative to the coupler portion.

15. The cable connector of claim 14, wherein the compression sleeve has a tapered inner surface configured to urge the body portion radially inward as the compression sleeve is moved in a forward direction relative to the body portion.

16. The cable connector of claim 4, wherein the radially compressible grounding portion is a C-shaped washer or a C-shaped ring.

17. The cable connector of claim 4, wherein the radially compressible grounding portion is configured to be radially compressed by an inner surface of the outer conductor engager when the coupler portion is coupled with an interface port.

* * * * *